US005133126A

United States Patent [19]

Matsuoka

[11] Patent Number: 5,133,126

[45] Date of Patent: Jul. 28, 1992

[54] METHOD OF PRODUCING ALUMINUM TUBE COVERED WITH ZINC

[75] Inventor: Tatsuru Matsuoka, Oyama, Japan

[73] Assignee: Furukawa Aluminum Co., Ltd., Tokyo, Japan

[21] Appl. No.: 780,566

[22] Filed: Oct. 21, 1991

Related U.S. Application Data

[63] Continuation of Ser. No. 664,505, Mar. 5, 1991, abandoned, which is a continuation of Ser. No. 390,304, Aug. 7, 1989, abandoned.

[30] Foreign Application Priority Data

Aug. 9, 1988 [JP] Japan ..... 63-198380

[51] Int. Cl.[5] ..... B22D 11/126

[52] U.S. Cl. ..... 29/527.4; 29/890.053; 72/262; 427/423; 427/321; 228/164; 228/183; 228/238

[58] Field of Search ..... 29/527.4, 890.03, 890.032, 29/890.053, 890.054; 228/238, 183, 164; 428/650, 658; 427/34, 321, 423; 72/38, 47, 253.1, 262

[56] References Cited

U.S. PATENT DOCUMENTS 4,615,952 10/1986 Knoll ..... 428/650
4,842,185 6/1989 Kudo et al. ..... 228/183

FOREIGN PATENT DOCUMENTS 60-1087 1/1985 Japan .
0259832 5/1985 Japan ..... 72/253.1
63-03851 6/1988 Japan ..... 228/183

*Primary Examiner*—Mark Rosenbaum
*Assistant Examiner*—S. Thomas Hughes
*Attorney, Agent, or Firm*—Armstrong, Nikadio, Marmelstein, Kubovcik & Murray

[57] ABSTRACT

A method of producing an aluminum tube covered by a layer of zinc using a continuous cold forming machine which includes the steps of: providing an extrusion die having a heating device and an inert gas-blowing tube to the cold forming machine, introducing an aluminum prime wire to the cold forming machine, extruding the prime wire through the extrusion die to form an aluminum tube while heating the die to a high temperature and blowing an inert gas across the die toward the tube to provide a high-temperature, non-oxidized aluminum tube, and flame spraying zinc powder onto the outer non-oxidized surface of the tube to cover the surface and provide an anticorrosive layer of zinc on the aluminum tube.

1 Claim, 2 Drawing Sheets

METHOD OF PRODUCING ALUMINUM TUBE COVERED WITH ZINC

This application is a continuation of application Ser. No. 664,505 filed Mar. 5, 1991, which in turn is a continuation of application Ser. No. 390,304, filed on Aug. 7, 1989, both now abandoned.

BACKGROUND OF THE INVENTION

The present invention is an improved method of producing an aluminum tube covered with a layer of zinc, which is usable in a heat-exchanger or similar product and which has excellent corrosion resistance, through the use of a continuous cold forming machine.

Conventionally, a flat aluminum tube or a round aluminum tube for a heat-exchanger has been coiled with a winder after extrusion through a hot extruder.

With this method, however, a seam is caused for every extruded billet and air or oil penetrates into the seam portion resulting in many defects, frequently referred to as blisters. Hence, this method cannot be used for producing a heat-exchanger wherein a high degree of pressure endurance and corrosion resistance are required, and the weight of the billet providing the material is greater than necessity to obtain a defect-free coil. Namely, a seam exists usually for every coil of 30 to 50 kg and the portion having the seam cannot be reliably used where pressure endurance and corrosion resistance are required. The seamed portion is usually discarded.

A method for improving the corrosion resistance of such an aluminum tube has been proposed. For example, as shown in Japanese Unexamined Patent Publication No. Sho 58-204169, using aluminum material as a metal extrusion material, Zn was flame-sprayed onto the surface of the aluminum material in the vicinity of the extruding outlet of a hot or cold extrusion forming machine to form a Zn layer on the aluminum material.

However, even though an anticorrosive aluminum tube may be produced by this method, it has been impossible to produce a coil comprising a long seamless aluminum tube for the reasons described above.

As a further improvement, another method of producing aluminum tube by using a continuous cold forming machine was recently proposed. For example, as shown in Japanese Unexamined Patent Publication No. Sho 60-1087, this method utilizes prime materials such as aluminum etc. which are supplied into a long and narrow pathway formed from a mandrel groove provided on the circumference of a movable wheel and a fixed seal block engaging with the groove. The prime materials are fed compulsively into the pathway by the contact and friction resistance between the inner face of the groove of the rotating movable wheel and the prime materials to generate an extruding pressure on the prime materials, and extruded aluminum tubes are produced through a die attached to a forward end of the machine.

According to this method, it is possible to produce a seamless coil having a weight 10 to 20 times heavier than a coil produced by the method of producing aluminum tube through a hot extruder as previously described.

In this method, however, since the surface temperature of the aluminum tube extruded from the continuous cold forming machine is as low as 200° to 400° C., the Zn does not diffuse sufficiently into the surface when it is sprayed onto the surface which results in a poor adhesion strength between the aluminum tube and the Zn.

Thus, it has been impossible to accomplish the purpose of providing a satisfactory Zn-covered layer on an aluminum tube.

As a result of diligent studies in view of this situation, a seamless aluminum tube has been produced through the use of a continuous cold forming machine and a method of producing a Zn-covered aluminum tube provided with an anticorrosive layer of Zn on the outer surface thereof, which is excellent in adhesion strength, has been developed according to the invention.

SUMMARY OF THE INVENTION

The invention is a method of producing an aluminum tube covered by a layer of zinc using a continuous cold forming machine which includes the steps of: providing an extrusion die having a heating device and an inert gas-blowing tube to the cold forming machine, introducing an aluminum prime wire to the cold forming machine, extruding the prime wire through the extrusion die to form an aluminum tube while heating the die to a high temperature and blowing an inert gas across the die toward the tube to provide a high-temperature, non-oxidized aluminum tube, and flame spraying zinc powder onto the outer non-oxidized surface of the tube to cover the surface and provide an anticorrosive layer of zinc on said aluminum tube. In the preferred embodiment, the temperature of the extrusion die is maintained within a range of 450° to 550° C.

DETAILED DESCRIPTION OF THE INVENTION

In practicing the method of the present invention, a continuous cold forming machine, such as, for example, shown in Japanese Unexamined Patent Publication No. Sho 60-1087 described above is used.

Moreover, in the invention, since the aluminum prime wire is heated by the heating device provided at the forward end of the continuous forming machine while it is extruded as an aluminum tube from the extrusion die, the aluminum tube is also heated to an elevated temperature. Hence, when covering the outer surface of the tube with zinc, the zinc can penetrate and diffuse into the inner part of the surface of the aluminum tube. Thereby, aluminum and zinc are brought into an alloy in a surface diffusion layer making it possible to improve the adhesion strength of the zinc layer and to provide an excellent anticorrosive layer.

The heating temperature is preferable to be 450° to 550° C. or so. The reason is, in the case of the temperature being under 450° C., it is difficult to allow zinc to adhere closely to the surface of the aluminum tube and, if the temperature exceeds 550° C., the temperature of the material becomes too high and results in the occurrence of face roughening and burn-sticking (pick up) as the material traverses the extrusion die.

Moreover, an inert gas, for example, nitrogen gas or argon gas is blown into the extrusion die in the invention because the surface of the aluminum tube might otherwise become oxidized at high temperature, and an oxidized surface would inhibit covering the tube with zinc and therefore such oxidizing is to be prevented.

In the invention, it is also to be understood that aluminum includes aluminum alloys in addition to pure aluminum and zinc includes zinc alloys. Similar effects can be achieved even with alloys.

EXAMPLE 1

Figure 1:
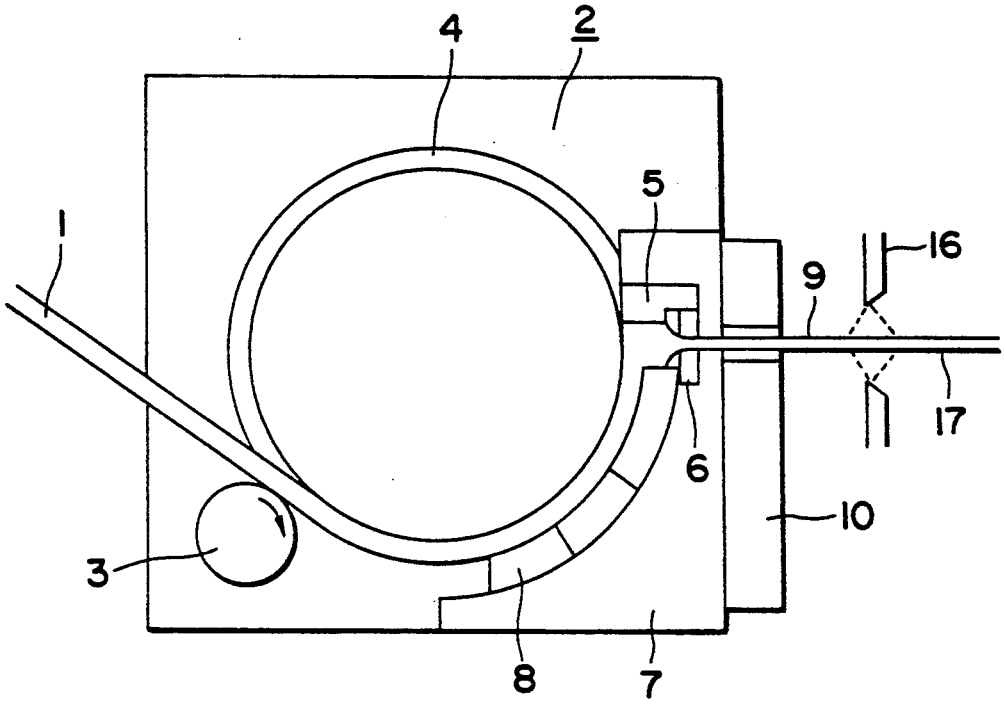
FIG. 1 is a diagrammatic illustration showing in outline form the method of producing aluminum tube with a conventional continuous extruder.

As shown in FIG. 1, an aluminum prime wire (aluminum alloy JIS A 1050) 1 was introduced into a continuous cold forming machine 2. Here, the prime wire was fed to a groove on a wheel 4 through a backup roll or coining roll 3. The wheel 4 was allowed to rotate while the prime wire was allowed to run to an abutment 5 by the frictional force thereof, and the prime wire was extruded from an extrusion die 6 attached to the upper end of shoe 7 and seal segment 8 to obtain an aluminum tube 9. Numeral 10 designates a block.

Figure 2:
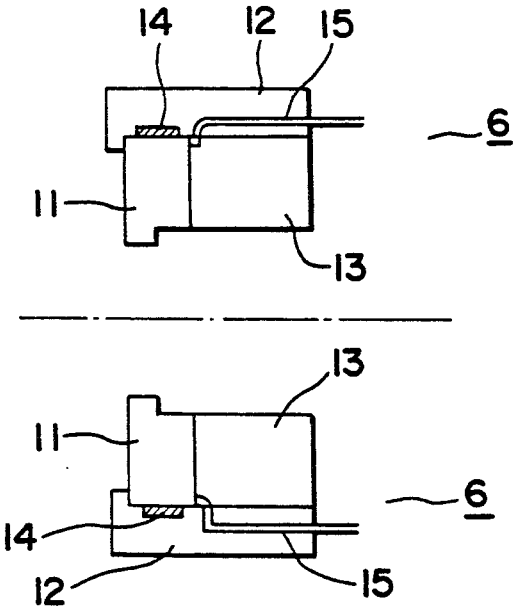
FIG. 2 is a diagrammatic illustration showing an extrusion die to be attached to the continuous extruder of FIG. 1 for use in practicing the method of the present invention.

More specifically, the extrusion die 6 was constructed, as shown in FIG. 2, by assembling an annular die body 11, concentric die ring 12 and backer 13 and, after the temperature of the die body 11 was adjusted to a temperature in the range of 480° to 510° C. by a heating device, for example, a heater 14 mounted between the die body 11 and the die ring 12, the aluminum prime material 1 was extruded as above.

Moreover, a nitrogen gas-blowing tube 15 was attached to the die body 11 and nitrogen gas was blown at a pressure of 0.5 kg/cm$^2$ from outside of the extrusion die 6 into the die body 11.

The die ring 12 and the backer 13 are attached to the die body 11 to support the die body 11 with the die ring 12 and the backer is provided to prevent deformation of the die body 11 due to pressure experienced during the extrusion process.

Figure 3:
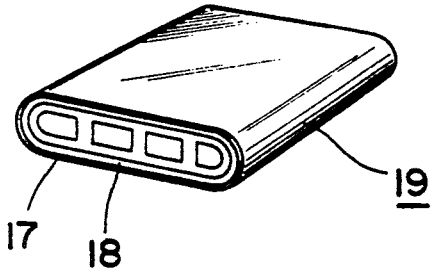
FIG. 3 is a perspective view showing an aluminum tube covered with zinc.

Thereafter, zinc powder was flame-sprayed circumferentially around the outer surface of the aluminum tube 9 under the flame-spraying conditions as shown in Table 1 using a flame-spraying device 16 to provide a Zn-covered layer 17 having a diffused layer 18 of Zn as shown in FIG. 3 and to obtain an aluminum tube covered with zinc 19 for the heat-exchanger of the invention, which had a height of 5 mm, a wall thickness of 0.8 mm and a width of 22 mm.

TABLE 1

| | |
|---|---|
| Voltage | 40 V |
| Current | 50 A |
| Wire diameter of Zn | 1.6 ϕ mm |
| Product speed | 20 m/min |
| Blowing pressure | 4 kg/cm$^2$ |

COMPARATIVE EXAMPLE 1

A comparative example of an aluminum tube was prepared using the same apparatus and method as was in Example 1, except that only the die body 11, die ring 12 and backer 13 were assembled for use as an extrusion die instead of the complete assembly of the extrusion die 6 as shown by FIG. 2. After extrusion, zinc powder was flame-sprayed onto the outer circumferential surface of the aluminum tube under the flame-spraying conditions shown in Table 1 to obtain an aluminum tube covered with zinc 19 for the heat-exchanger of the comparative example, to which a zinc-covered layer 17 as shown in FIG. 3 was provided.

Certain characteristics of the zinc applied to the aluminum tube covered with zinc in accordance with the present invention and the aluminum tube covered with zinc in the Comparative Example 1 were measured, respectively. The results are as shown in Table 2.

TABLE 2

| | Example 1 | Comparative Example 1 |
|---|---|---|
| Weight of Zn adhered (g/m$^2$) | 10.3 | 10.2 |
| Depth of diffusion of Zn (μ) | 40 | 2 |
| Peeling-off of Zn layer on bending processing | No | Yes |
| CAS test (Maximum depth of pit corrosion after 720 hours, mm) | 0.16 | 10.2 |

EXAMPLE 2

A round aluminum alloy tube was formed with a continuous extruder similar to that used in Example 1 using a prime wire of JIS A 3003 aluminum alloy. The formed aluminum alloy tube was then covered with zinc in a manner similar to the method of Example 1 to obtain an aluminum tube covered with zinc in accordance with the present invention having an outer diameter of 16 mm and a wall thickness of 1.2 mm.

COMPARATIVE EXAMPLE 2

Thereafter a round aluminum alloy tube was molded similarly to Comparative Example 1 using a prime wire of JIS A 3003 aluminum alloy. Zinc-covering was carried out using the apparatus and method of Comparative Example 1 to obtain an aluminum tube covered with zinc.

Certain characteristics of the zinc applied to the aluminum alloy tube covered with zinc in Example 2 of the present invention and the aluminum alloy tube covered with zinc in Comparative Example 2 were measured, respectively. The results are as shown in Table 3.

TABLE 3

| | Example 2 | Comparative Example 2 |
|---|---|---|
| Weight of Zn adhered (g/m$^2$) | 8.6 | 8.5 |
| Depth of diffusion of Zn (μ) | 35 | 2 |
| Peeling-off of Zn layer on bending processing | No | Yes |
| CAS test (Maximum depth of pit corrosion after 720 hours, mm) | 0.13 | 0.76 |

As evident from Table 2 and Table 3, the weight of Zn adhered is almost same between the articles or examples of the present invention and the comparative article. In the case of the comparative examples, however, zinc hardly diffuses beneath the surface of aluminum tube because of the low temperature of tubes when the tubes were sprayed with undesirable result that the anticorrosive layer of Zn peels off during U-shape bending processing of the aluminum tubes. The aluminum tubes of the Comparative Example 2 also have four times or more as many as pit corrosions compared with Examples 1 and 2 of the present invention as evident by the results of the CAS test of corrosion resistance. Thus, with a conventional article as represented by the Comparative Examples 1 and 2, since no Zn diffuses into the surface of the aluminum tube, the aluminum corrodes within a short term after the corrosion of Zn. Whereas, in the case of articles or Examples 1 and 2 of the present invention, because of deep diffusion of Zn into the aluminum tube surface, an alloy layer of both of these metals is formed and the Zn does not peel off even on bending processing and exhibits excellent corrosion resistance.

As described above in detail, in accordance with the method of the present invention, the aluminum tube and Zn anticorrosive layer are brought together as an alloy in a diffusion layer which provides strong adherence and excellent corrosion resistance and, at the same time, produces a seamless aluminum tube. For this reason and others, the invention is extremely useful in industry.

I claim:

1. A method of producing an aluminum tube covered by a layer of zinc using a continuous cold forming machine which comprises the steps of:

providing said cold forming machine with an extrusion die assembly comprised of an annular die body, a backer and a die ring concentric with said die body, a heating device between said die body and said die ring and an inert gas-blowing tube;

introducing an aluminum prime wire to said cold forming machine;

extruding said prime wire through said extrusion die thereby forming an aluminum tube while heating said die to a temperature within a range of 450° to 550° C.;

blowing an inert gas across said die toward said tube thereby providing a high-temperature, non-oxidized aluminum tube; and flame spraying zinc powder onto the outer non-oxidized surface of said tube thereby covering said surface and providing an anticorrosive layer of zinc on said aluminum tube.

* * * * *